US011486162B2

(12) United States Patent
Larson

(10) Patent No.: US 11,486,162 B2
(45) Date of Patent: Nov. 1, 2022

(54) LOCKING MODULE

(71) Applicant: Carrier Corporation, Jupiter, FL (US)

(72) Inventor: Wayne Floyd Larson, Salem, OR (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 295 days.

(21) Appl. No.: 16/490,364

(22) PCT Filed: Feb. 28, 2018

(86) PCT No.: PCT/US2018/020258
§ 371 (c)(1),
(2) Date: Aug. 30, 2019

(87) PCT Pub. No.: WO2018/160718
PCT Pub. Date: Sep. 7, 2018

(65) Prior Publication Data

US 2019/0383057 A1 Dec. 19, 2019

Related U.S. Application Data

(60) Provisional application No. 62/465,404, filed on Mar. 1, 2017.

(51) Int. Cl.
*E05B 19/00* (2006.01)
*E05B 47/00* (2006.01)
*E05B 67/06* (2006.01)

(52) U.S. Cl.
CPC ..... *E05B 19/0005* (2013.01); *E05B 47/0001* (2013.01); *E05B 67/063* (2013.01)

(58) Field of Classification Search
CPC ..... E05B 19/0005; E05B 47/0001; E05B 67/063; E05B 2047/002; E05B 47/0012;
(Continued)

(56) References Cited

U.S. PATENT DOCUMENTS 1,455,770 A * 5/1923 Anderson ..... E05B 67/22 70/35
1,703,193 A * 2/1929 Jacobi ..... E05B 67/24 70/38 A (Continued)

FOREIGN PATENT DOCUMENTS

| | | | |
|---|---|---|---|
| CN | 2692284 | Y | 4/2005 |
| WO | 0125864 | A1 | 4/2001 |
| WO | 2015045765 | A1 | 4/2015 |

OTHER PUBLICATIONS

International Search Report for International Application No. PCT/US2018/020258; International Filing Date Feb. 28, 2018; dated May 18, 2018; 12 pages.

(Continued)

*Primary Examiner* — Lloyd A Gall
(74) *Attorney, Agent, or Firm* — Cantor Colburn LLP

(57) ABSTRACT

A locking module for selectively coupling a first component and a second component of a lockable device includes a locking member rotatable about an axis between a rest position and an actuated position. An engagement member is movable between a locked position and an unlocked position. The engagement member is configured to cooperate with the locking member to selectively release the second component.

16 Claims, 6 Drawing Sheets

(58) Field of Classification Search
CPC ..... E05B 67/22; E05B 67/24; Y10T 70/5031; Y10T 70/7102; Y10T 70/7107; Y10T 70/452; Y10T 70/454; Y10T 70/459; Y10T 70/461; Y10T 70/463; Y10T 70/47
USPC ..... 70/63, 278.7, 279.1, 38 R, 38 A, 38 B, 70/38 C, 39, 43
See application file for complete search history.

(56) References Cited

U.S. PATENT DOCUMENTS 1,743,331 A * 1/1930 Ellison ..... E05B 67/22 70/38 A
2,132,201 A * 10/1938 Allman ..... E05B 37/163 70/25
2,173,720 A * 9/1939 James ..... E05B 37/10 70/25
2,830,447 A 4/1958 Miller
2,852,928 A 9/1958 Miller
2,893,231 A * 7/1959 Soref ..... E05B 37/10 70/25
3,695,067 A * 10/1972 Bays ..... B60R 25/04 70/63
4,236,394 A * 12/1980 Harrington ..... E05B 37/04 70/25
4,609,780 A * 9/1986 Clark ..... G07C 9/00722 379/102.06
4,641,505 A * 2/1987 Maurice ..... E05B 19/0005 70/162
5,017,851 A * 5/1991 Heinzman ..... E05B 37/08 318/685
5,184,491 A * 2/1993 Schittenhelm ..... E05B 37/08 70/278.1
5,791,172 A * 8/1998 Deighton ..... E05B 19/0005 292/199
6,047,575 A 4/2000 Larson et al.
6,337,618 B1 * 1/2002 Craig ..... E05B 67/22 340/5.22
6,401,501 B1 6/2002 Kajuch et al.
7,948,359 B2 5/2011 Marcelle et al.
8,225,630 B1 * 7/2012 Chen ..... E05B 35/105 70/21
8,453,481 B2 6/2013 Meekma
8,850,858 B2 10/2014 Nave
9,109,379 B1 8/2015 Ranchod
2004/0226325 A1 * 11/2004 Ling ..... E05G 1/005 70/63
2007/0113600 A1 * 5/2007 Marcelle ..... E05B 67/22 70/29
2008/0115544 A1 * 5/2008 Yang ..... E05B 19/0005 70/63
2013/0086956 A1 * 4/2013 Nave ..... E05B 47/0012 70/20
2014/0157838 A1 * 6/2014 Nave ..... E05B 47/06 70/52
2015/0292244 A1 * 10/2015 Beatty ..... E05B 47/0012 70/20
2020/0002973 A1 * 1/2020 Hill ..... E05B 47/004
2020/0071955 A1 * 3/2020 Binek ..... E05B 47/023
2020/0113600 A1 * 4/2020 Weiman ..... A61B 17/7061

OTHER PUBLICATIONS

Written Opinion for International Application No. PCT/US2018/020258; International Filing Date: Feb. 28, 2018; dated May 18, 2018; 16 pages.

* cited by examiner

LOCKING MODULE

CROSS REFERENCE TO RELATED APPLICATIONS

This application is a National Stage application of PCT/US2018/020258, filed Feb. 28, 2018, which claims the benefit of U.S. Provisional Application No. 62/465,404, filed Mar. 1, 2017, both of which are incorporated by reference in their entirety herein.

BACKGROUND

This disclosure relates generally to a lockable device and, more particularly, to a locking module for use in a lockable device.

Lockboxes typically provide a secured storage area for a key or other access aid at a location close to a locked property accessible by the key. In this way, an authorized user can unlock the lockbox to gain access to the secured storage area and then use the key contained therein to unlock the locked property.

The lockbox is typically attached to a door handle or to another stationary object near the traditional lock. The lockbox typically requires the user to demonstrate that he is authorized to obtain access to the locked property before the secured storage area is unlocked to allow the user to obtain the key. In a mechanical lockbox, the user might be required to enter a correct lock combination to access the secured storage area. In an electronic lockbox, the user might be required to communicate a credential to lockbox (via a physical connection to the lockbox or via a wireless link to the lockbox) to access the secured storage area.

SUMMARY

According to one embodiment, a locking module for selectively coupling a first component and a second component of a lockable device includes a locking member rotatable about an axis between a rest position and an actuated position. An engagement member is movable between a locked position and an unlocked position. The engagement member is configured to cooperate with said locking member to selectively release the second component.

In addition to one or more of the features described above, or as an alternative, in further embodiments when said engagement feature is in said locked position, said locking member is restricted from rotating to said actuated position.

In addition to one or more of the features described above, or as an alternative, in further embodiments when said engagement feature is in said locked position, a portion of said locking member is operably coupled to said second component to restrict movement of said second component.

In addition to one or more of the features described above, or as an alternative, in further embodiments when said engagement feature is in said unlocked position, said locking member is rotatable between said rest position and said actuated position.

In addition to one or more of the features described above, or as an alternative, in further embodiments when said locking member is in said actuated position, said locking member is decoupled from said second component.

In addition to one or more of the features described above, or as an alternative, in further embodiments said engagement member further includes a feature extending from an end of said engagement member, said feature being arranged within a path of rotation of said locking member when said engagement member is in said locked position, and said feature being arranged out of said path of rotation when said engagement member is in said unlocked position.

In addition to one or more of the features described above, or as an alternative, in further embodiments said locking member includes a shaped member and a locking cam pivotally connected to said shaped member.

In addition to one or more of the features described above, or as an alternative, in further embodiments said shaped member is associated with a biasing mechanism configured to bias said shaped member from said actuated position to said rest position.

In addition to one or more of the features described above, or as an alternative, in further embodiments an end of said locking cam is receivable within a cavity formed in said second component to restrict movement of said second component relative to said first component.

In addition to one or more of the features described above, or as an alternative, in further embodiments comprising a biasing mechanism extending between said locking cam and a surface of said shaped member, said biasing mechanism being operable to bias said locking cam to a position where said end of said locking cam is received within said cavity of said second component.

In addition to one or more of the features described above, or as an alternative, in further embodiments said locking member is mounted within a cavity of said first component, said locking cam being configured to engage a wall of said cavity when said engagement member is in said locked position and said locking member is rotated from said rest position.

In addition to one or more of the features described above, or as an alternative, in further embodiments a mechanism operably coupled to said engagement member is configured to move said engagement member between said locked position and said unlocked position.

In addition to one or more of the features described above, or as an alternative, in further embodiments said mechanism is a mechanical mechanism that operates the locking element in response to a user input.

In addition to one or more of the features described above, or as an alternative, in further embodiments said engagement mechanism is an electromechanical mechanism that operates the locking element in response to a user input.

In addition to one or more of the features described above, or as an alternative, in further embodiments the locking module is applied to a lockbox such that first component is a body of the lockbox and the second component is a shackle.

In addition to one or more of the features described above, or as an alternative, in further embodiments the locking module is applied to a lockbox such that first component is a body of the lockbox and the second component is a keybox.

According to another embodiment, a method of decoupling a movable component of a lockable device includes operating a mechanism in response to a user input, moving an engagement member from a locked position to an unlocked position, applying a force to the movable component, and rotating a locking member about an axis of rotation between a rest position and an actuated position. A portion of the locking element is selectively receivable within a cavity of the movable component of the lockable device.

In addition to one or more of the features described above, or as an alternative, in further embodiments moving said engagement member includes moving a feature of said engagement member out of a path of rotation of said locking member.

In addition to one or more of the features described above, or as an alternative, in further embodiments comprising biasing said locking member to said rest position upon removal of said force to the movable component.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

The detailed description explains embodiments of the present disclosure, together with advantages and features, by way of example with reference to the drawings.

DETAILED DESCRIPTION

Figure 1A:
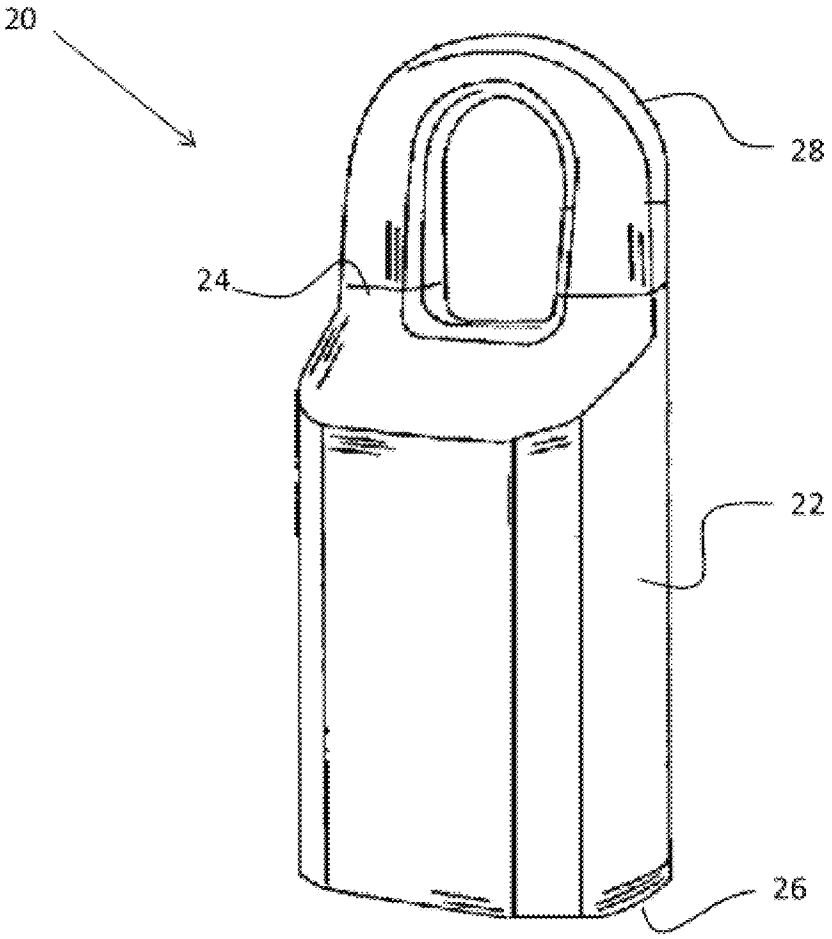
FIG. 1A is a perspective view of an example of a lockable device in a closed configuration.
Figure 1B:
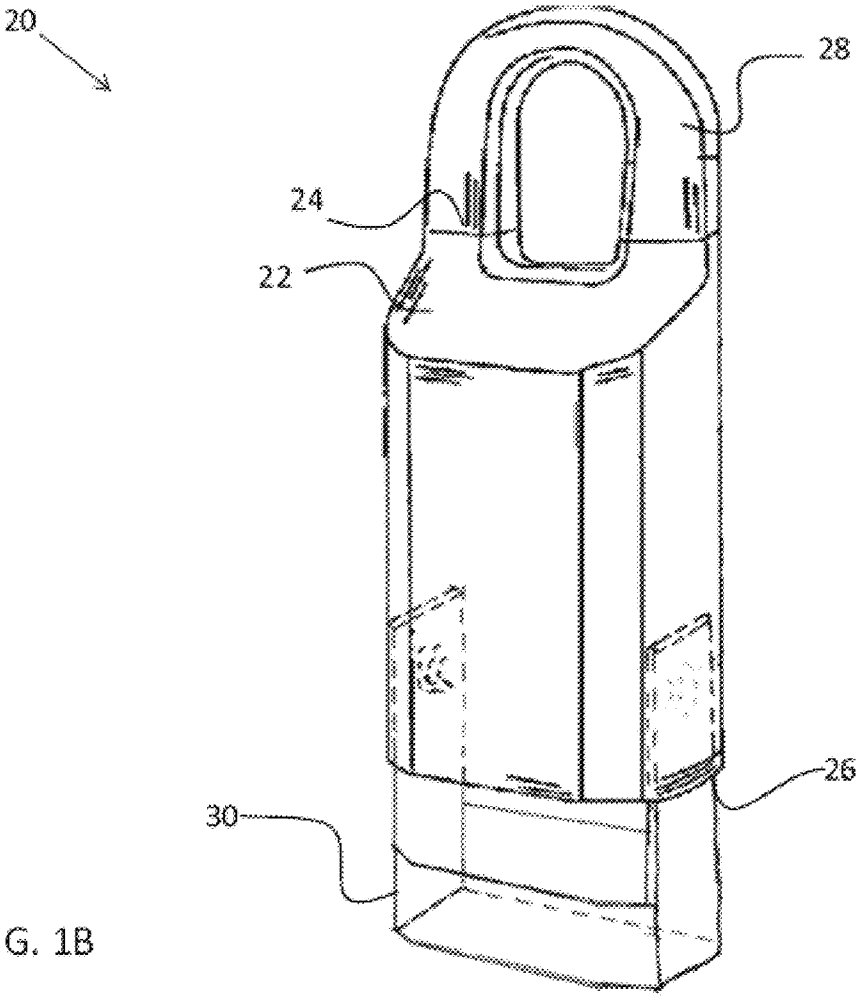
FIG. 1B is a perspective view of an example of a lockable device having a keybox in an extended position.

Referring now to FIGS. 1A and 1B, an example of a lockable device 20, such as a lockbox is illustrated. The lockbox 20 includes a body 22 and one or more components movable relative to the body 22. For example, the lockbox 20 additionally includes a shackle 28 positioned adjacent a first end 24 of the body 22 and a keybox 30 (best shown in FIG. 1B) positioned adjacent a second, opposite end 26 of the body 22. The shackle 28 may be configured to translate and/or rotate relative to the body 22. Alternatively, or in addition, the keybox 30 may be configured to translate relative to the body 22. In an embodiment, at least one of the shackle 28 and the keybox 30 is separable from the body 22.

A locking module 40 (see FIG. 2) is operable to selectively couple a first component and a second component. In an embodiment, when applied to a lockable device, such as lockbox 20 for example, the locking module 40 selectively locks the shackle 28 to the body 22. Accordingly, the locking module 40 restricts movement of the lockbox 20 once arranged in a desired location via the shackle 28. Alternatively or in addition, the locking module 40 may be used to selectively lock the keybox 30 to the body 22. In such instances, operation of the locking module 40 may provide an authorized user with access to the internal cavity of the keybox 30, within which one or more items, such as a key for example, may be stored.

Figure 2:
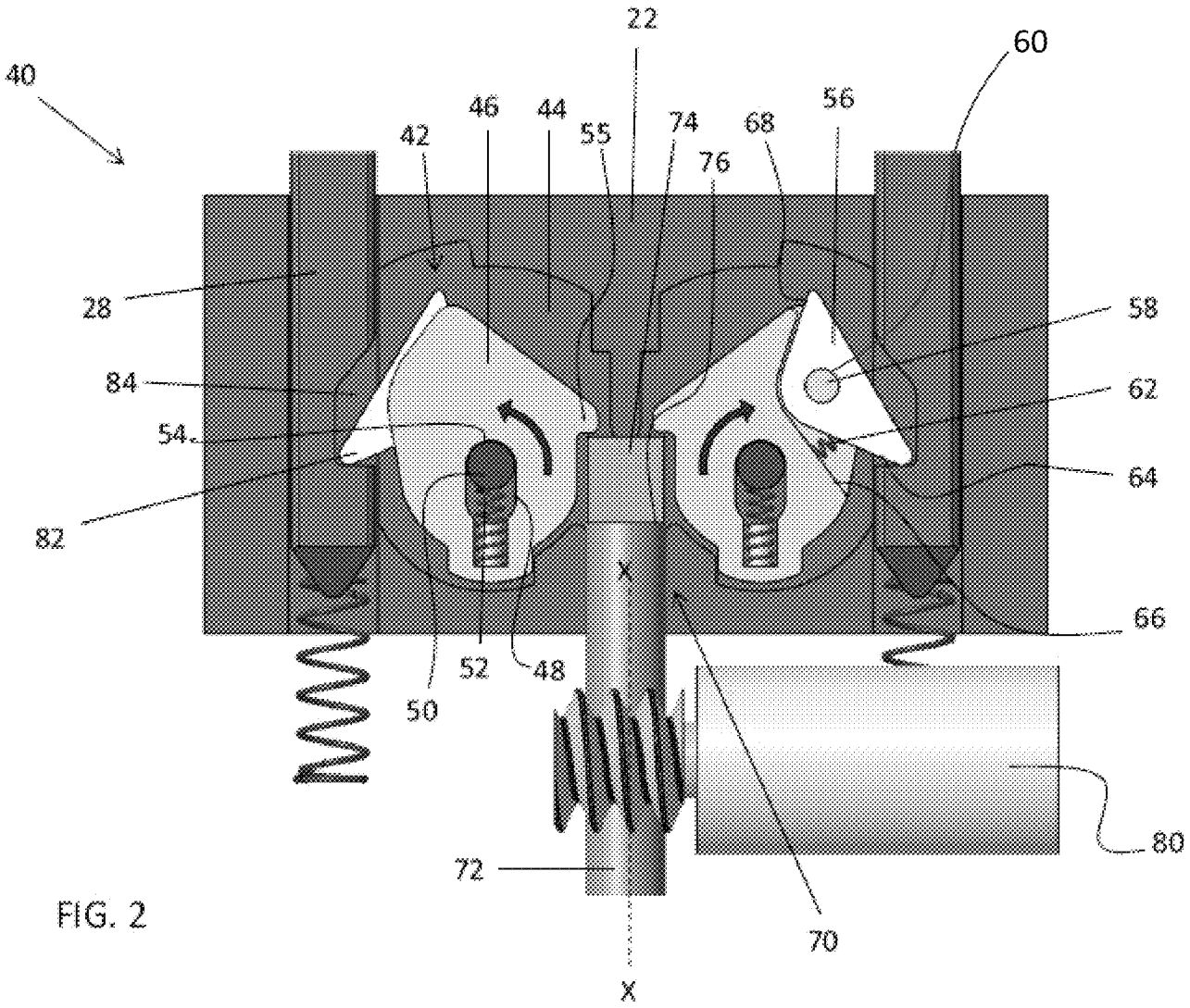
FIG. 2 is a front view of a locking module of the lockable device in a locked configuration according to an embodiment.

With reference now to FIG. 2, a locking module 40 configured to selectively couple the shackle 28 to the body 22 of a lockbox 20 is illustrated in more detail. As shown, the locking module 40 includes at least one locking member 42 rotatably supported within a contoured cavity 44 formed in the interior of the body 22 of the lockbox 20. In the illustrated, non-limiting embodiment, the locking module 40 includes two substantially identical locking members 42 configured to selectively engage opposing sides of the shackle 28. However, embodiments including only a single locking member 42 are also contemplated herein.

Each locking member 42 includes a shaped member 46 having an elongated central opening 48 configured to receive a post 50 extending from the body 22. The engagement between the post 50 and the opening 48 allows the shaped member 46 to translate and rotate relative to the body 22 within the cavity 44. In an embodiment, a biasing mechanism 52 is operably coupled to the post 50 and to a portion of the shaped member 46. The force of the biasing member 52 is configured to bias the shaped member 46 into a default or rest position where the post 50 is engaged with a first end 54 of the opening 48, as shown in FIG. 2. Each shaped member 46 includes a protrusion 55 configured to cooperate with an adjacent component, to be discussed in more detail below, to selectively restrict rotation of the shaped member 46 about its axis in a first direction.

A locking cam 56 is pivotally coupled to each shaped member 46. In the illustrated, non-limiting embodiment, the locking cam 56 is generally triangular in shape. However, a locking cam 56 having another shape is also contemplated herein. As shown, a post 58 extending from the shaped member 46 is received within a corresponding opening 60 formed in the locking cam 56. Another biasing mechanism 62, such as a coil spring for example, extends between a surface 64 of the locking cam 56 and an adjacent surface 66 of the shaped member 46. The biasing mechanism 62 is configured to bias the locking cam 56 to a position where a surface 68 of the locking cam 56 is in contact with surface 66 of the shaped member 46. As a result of the shape of the locking cam 56, only one of surface 64 and surface 68 can be arranged in contact with surface 66 of the shaped member 46 at any time.

Figure 4:
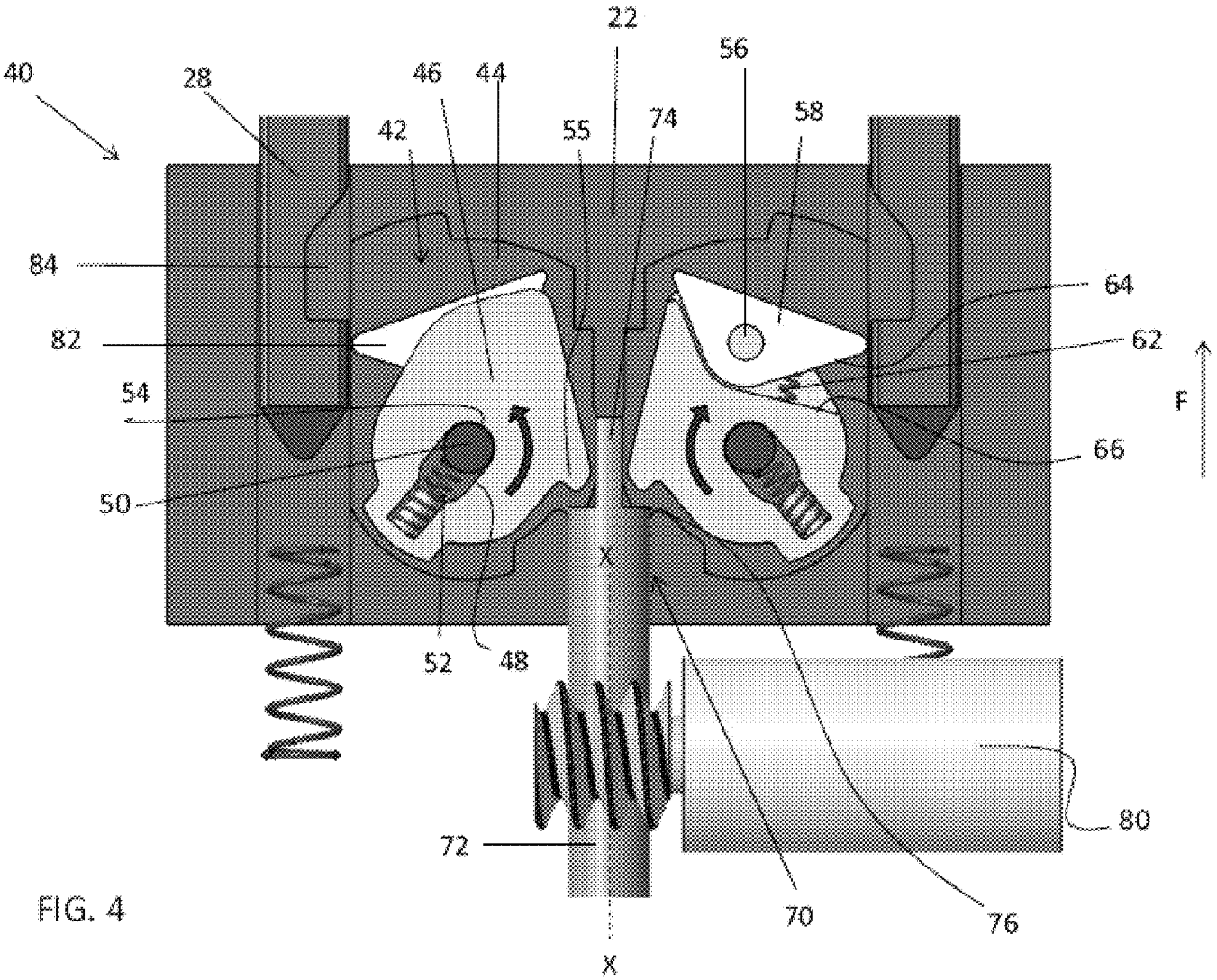
FIG. 4 is another front view of a locking module of the lockable device in an unlocked configuration according to an embodiment.

An engagement member 70 movable relative to the body 22 and the shaped members 46 is mounted adjacent the protrusion 55 of the one or more shaped members 46. The engagement member 70 is movable between a locked position and an unlocked position, and cooperates with the shaped members 46 to selectively release a coupled component, such as the shackle 28. In the illustrated non-limiting embodiment, the engagement member 70 includes a shaft 72 having a feature 74 formed at an end 76 thereof. As best shown in FIG. 4, the feature 74 does not cover the entire end 76. In the illustrated, non-limiting embodiment, the feature 74 is generally rectangular in shape and has a length substantially equal to a diameter of the shaft 72. However, a width of the feature 74 is substantially smaller than the diameter of the shaft 72. It should be understood that the feature 74 illustrated and described herein is intended as an example only, and other suitable configurations of the feature 74 are also within the scope of the disclosure.

The engagement member 70 is configured to rotate about an axis X between a first, locked configuration and a second, unlocked configuration in response to operation of a mechanism, illustrated schematically at 80, operably coupled to the engagement member 70. Although the engagement member 70 is shown as being rotatable about an axis X arranged substantially parallel to the shackle 28, other configurations of the engagement member 70 are also contemplated herein. The mechanism 80 for moving the engagement member 70 may be mechanically operated by a user, or alternatively, may include an electromechanical mechanism, such as a motor, solenoid, or a piezoelectric device for example, directly or indirectly coupled to the engagement member 70. In such embodiments, the mechanism 80 may be operable in response to an electrical input, such as generated by a code entered via a key pad or upon detection of an identification device, such as an RFID tag for example, having acceptable credentials.

The locking members 46 are configured to pivot about the post 50 between a rest position and an actuated position. In the rest position, the opening 48 within the shaped member 46 is oriented generally parallel to the shackle 28 and the engagement member 70. In addition, the end 82 of the lock cam 56 arranged adjacent the shackle 28 is located within a cavity 84 formed in the shackle 28. In the actuated position, the shaped member 46 and the lock cam 56 are rotated about the post 50, in a direction away from the shackle 28, such that the protrusion 55 of the shaped member 46 is moved towards the end 76 of the engagement member 70.

When the engagement member 70 is in the locked position, the width of the feature 74 extends between the opposing legs of the shackle 28, adjacent the protrusion 55 of the shaped member 46 in the rest position. When the engagement member 70 is in the unlocked position, the feature 74 is rotated, for example about 90 degrees, such that the width of the feature 74 extends between a front and back of the body 22. When the engagement member 70 is in the unlocked position, the feature 74 does not interact with the protrusion 55 of the shaped member 46.

Figure 3:
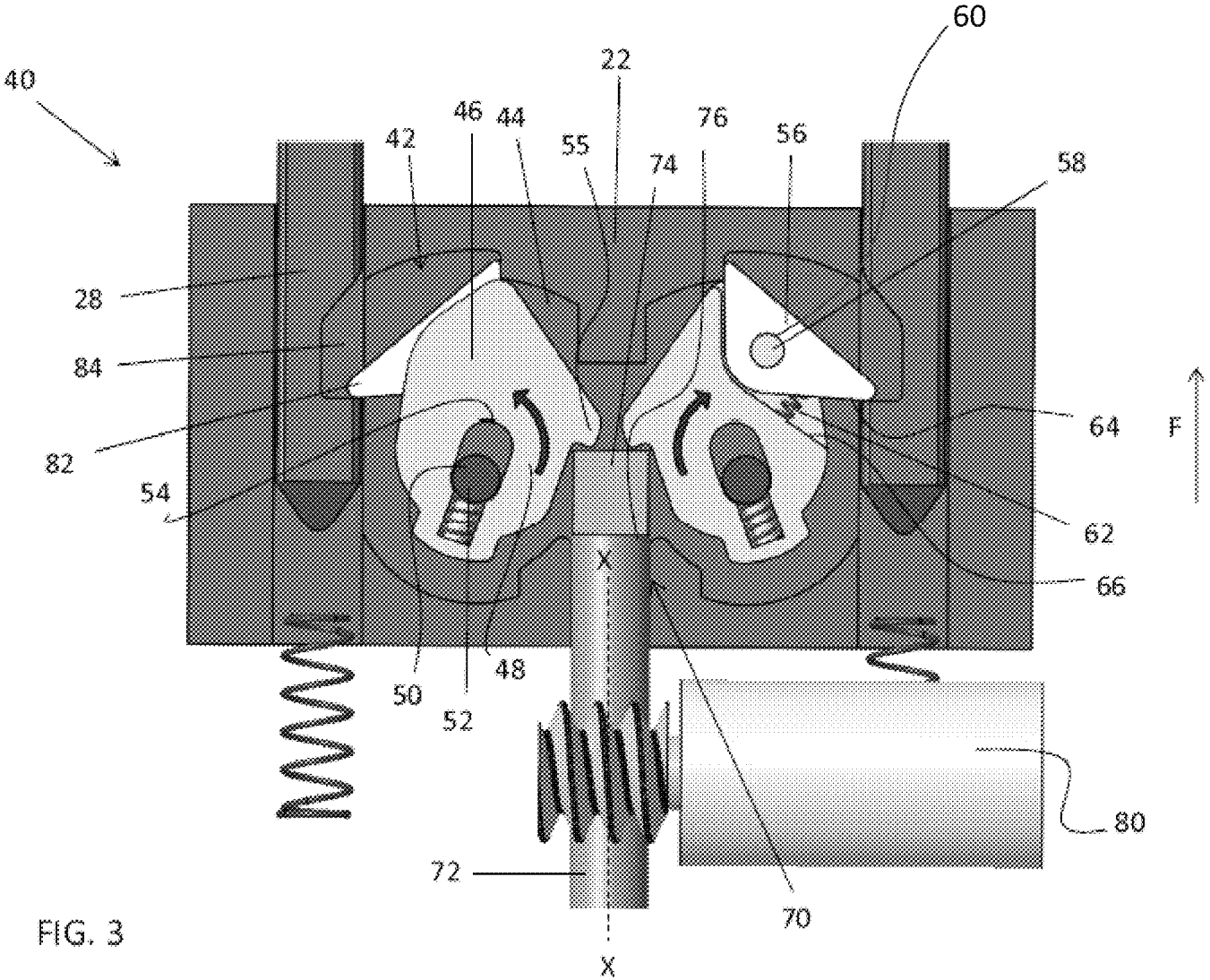
FIG. 3 is a front view of a locking module of the lockable device when the shackle is actuated and the locking module is in a locked configuration according to an embodiment.

If a force, indicated by arrow F, is applied to the shackle 28 to separate the shackle 28 from the body 22, the shackle 28 transmits the force F to the end 82 of the lock cam 56, causing the shaped member 46 and the lock cam 56 to rotate about the post 50 (see FIG. 3). If the engagement member 70 is in the locked position, as shown in FIG. 2, the feature 74 is generally aligned with the protrusion 55 of the shaped member 46. Accordingly, rotation of the shaped member 46, as driven by the shackle 28, is restricted by engagement between the protrusion 55 and the feature 74 (FIG. 3). Alternatively, or in addition, a portion of the lock cam 56 may engage a corresponding wall of the cavity 44. As a result, the end 82 of the locking cam 56 remains positioned within the cavity 84 of the shackle 28, thereby restricting movement of the shackle 28 relative to the locking module 40 and the body 22. When the force F is removed, the biasing force of the biasing mechanism 52 causes the shaped member 46 to return to the rest position.

Figure 5:
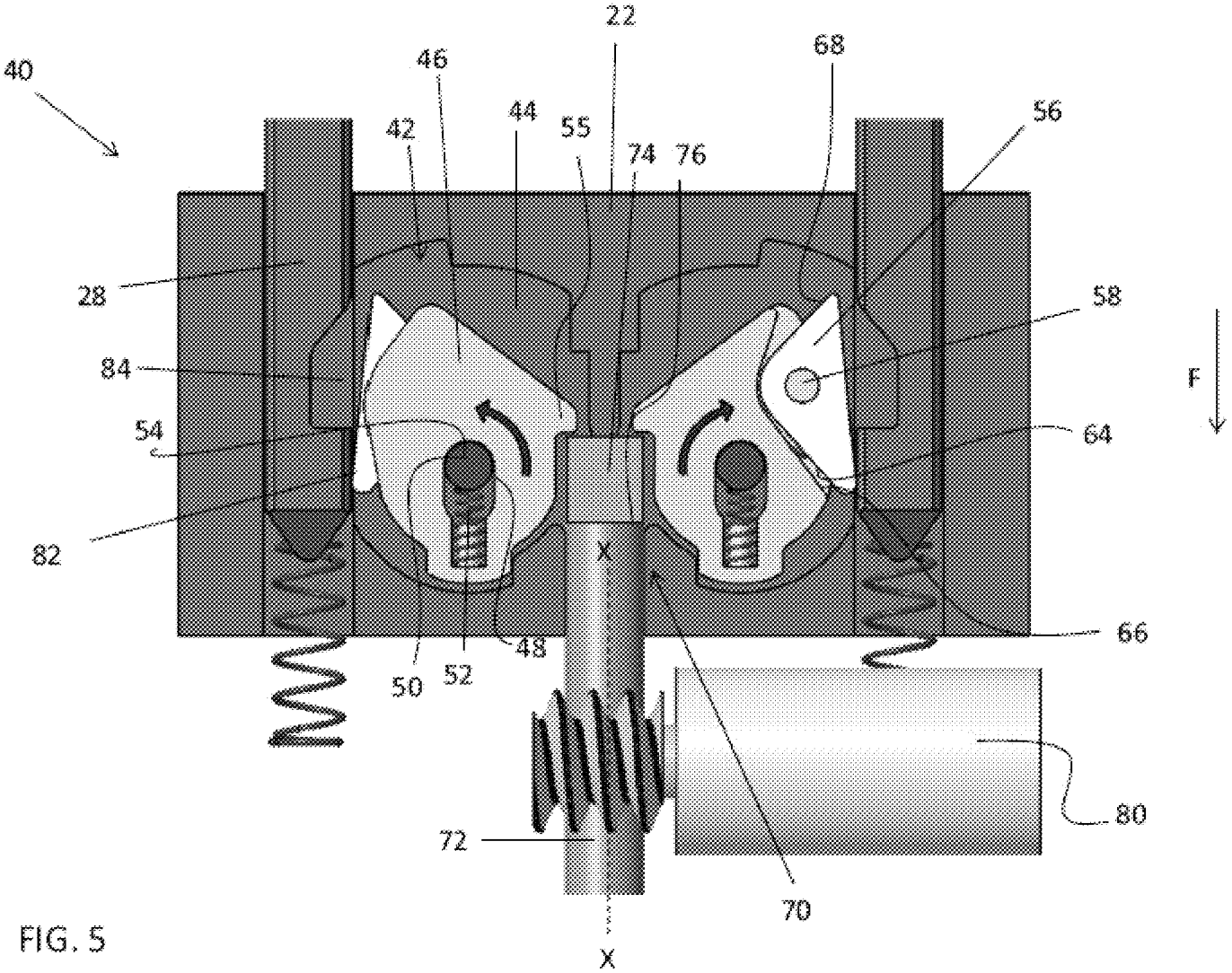
FIG. 5 is a front view of a locking module of the lockable device when the shackle is reinserted according to an embodiment.

If the force F is applied to the shackle when the engagement member 70 is in an unlocked position, as shown in FIG. 4, the lock cam 56 and the shaped member 46 similarly rotate about the post 50. Because the feature 74 is not arranged within the path of rotation of the protrusion 55 of the shaped member 46, the shaped member 46 is able to pivot further about post 50 to a position where the end 82 of the lock cam 56 is no longer within the cavity 84 of the shackle 28. As a result, the locking member 42 is disengaged from the shackle 28, and the shackle 28 is free to move relative to the locking module 40 and the body 22. Upon removal of the shackle 28, the biasing force of the biasing mechanism 52 causes the shaped member 46 to return to the rest position. When the shackle 28 is reinserted into the body 22, as shown in FIG. 5, the shackle 28 engages the end 82 of the lock cam 56 causing the lock cam 56 to rotate relative to the shaped member 46. This rotation of surface 64 of the lock cam towards surface 66 of the shaped member 46 moves the end 82 of the lock cam 56 out of interference with the shackle 28. Once the shackle 28 reaches a position where the cavity 84 is substantially aligned with the end 82 of the lock cam 56, the biasing force of the biasing mechanism 62 causes the lock cam 56 to bias back to a position where the end 82 of the lock cam 56 is positioned within the cavity 84. The shackle 28 may be reinserted when the engagement member 70 is in either a locked or unlocked position.

The locking module 40 illustrated and described herein has a simplified configuration resulting in a reduced cost. Further, the compact design of the locking module 40 eliminates the required space within the body 22.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in spirit and/or scope. Additionally, while various embodiments have been described, it is to be understood that aspects of the present disclosure may include only some of the described embodiments. Accordingly, the present disclosure is not to be seen as limited by the foregoing description, but is only limited by the scope of the appended claims.

What is claimed:

1. A locking module for selectively coupling a first component and a second component of a lockable device comprising:

a locking member rotatable and translatable about an axis between a rest position and an actuated position;

an engagement member rotatable about an axis extending parallel to the second component between a locked position and an unlocked position, said engagement member being configured to cooperate with said locking member to selectively release the second component;

wherein said engagement member further comprises a feature extending from an end of said engagement member, said feature being arranged within a path of rotation of said locking member when said engagement member is in said locked position, and said feature being arranged out of said path of rotation when said engagement member is in said unlocked position.

2. The locking module of claim 1, wherein when said engagement member is in said locked position, said locking member is restricted from rotating to said actuated position.

3. The locking module of claim 1, wherein when said engagement member is in said locked position, a portion of said locking member is operably coupled to said second component to restrict movement of said second component.

4. The locking module of claim 1, wherein when said engagement member is in said unlocked position, said locking member is rotatable between said rest position and said actuated position.

5. The locking module of claim 1, wherein when said locking member is in said actuated position, said locking member is decoupled from said second component.

6. The locking module of claim 1, wherein said locking member includes a shaped member and a locking cam pivotally connected to said shaped member, said shaped member being mounted via a post.

7. The locking module of claim 6, further comprising a biasing member arranged between said post and a portion of said shaped member, the biasing member being configured to bias said shaped member from said actuated position to said rest position.

8. The locking module of claim 6, wherein an end of said locking cam is receivable within a cavity formed in said second component to restrict movement of said second component relative to said first component.

9. The locking module of claim 8, further comprising a biasing mechanism extending between said locking cam and a surface of said shaped member, said biasing mechanism being operable to bias said locking cam to a position where said end of said locking cam is received within said cavity of said second component.

10. The locking module of claim 6, wherein said locking member is mounted within a cavity of said first component, said locking cam being configured to engage a wall of said cavity when said engagement member is in said locked position and said locking member is rotated from said rest position.

11. The locking module of claim 1, wherein a mechanism operably coupled to said engagement member is configured to move said engagement member between said locked position and said unlocked position.

12. The locking module of claim 11, wherein said mechanism is a mechanical mechanism that operates the engagement member in response to a user input.

13. The locking module of claim 11, wherein said is an electromechanical mechanism that operates the engagement member in response to a user input.

14. The locking module of claim 1, wherein the locking module is installed within a lockbox such that the first component is a body of the lockbox and the second component is a shackle.

15. A method of decoupling a movable component of a lockable device with a locking module comprising:

operating a mechanism in response to a user input;

rotating an engagement member about an axis extending parallel to the lockable device from a locked position to an unlocked position, wherein a feature extends from an end of said engagement member and moving said engagement member from said locked position to said unlocked position further comprises rotating said feature out of a path of rotation of a locking member;

applying a force to the movable component; and rotating and translating said locking member about an axis of rotation between a rest position and an actuated position, a portion of said locking member being selectively receivable within a cavity of the movable component of the lockable device.

16. The method of claim 15, further comprising biasing said locking member to said rest position upon removal of said force to the movable component.

* * * * *